US009620892B2

(12) United States Patent
Ng et al.

(10) Patent No.: US 9,620,892 B2
(45) Date of Patent: Apr. 11, 2017

(54) MULTI-DIRECTIONAL WIRING ROUTING DEVICE AND METHOD OF OPERATING THE SAME

(71) Applicant: J.S.T. CORPORATION, Farmington Hills, MI (US)

(72) Inventors: Vern Shen Ng, Singapore (SG); Tommy Chin Yaw Tan, Singapore (SG); Stella Shu Juan Peh, Singapore (SG); Stephanie Chu Ping Neo, Singapore (SG); Franklin Holub, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 417 days.

(21) Appl. No.: 14/098,842

(22) Filed: Dec. 6, 2013

(65) Prior Publication Data

US 2015/0162693 A1 Jun. 11, 2015

(51) Int. Cl.
*H01R 13/506* (2006.01)
*H01R 43/20* (2006.01)
*H01R 13/58* (2006.01)

(52) U.S. Cl.
CPC ..... *H01R 13/5841* (2013.01); *H01R 13/5812* (2013.01); *Y10T 29/49826* (2015.01)

(58) Field of Classification Search
CPC .. H01R 13/506; H01R 43/20; Y10T 29/49826
USPC ..... 174/135
See application file for complete search history.

(56) References Cited

U.S. PATENT DOCUMENTS

| | | | | |
|---|---|---|---|---|
| 5,076,802 | A | 12/1991 | Colleran | |
| 5,234,358 | A * | 8/1993 | Polgar | H01R 13/506 439/465 |
| 5,620,334 | A * | 4/1997 | Quillet | H01R 13/5804 439/464 |
| 5,788,528 | A | 8/1998 | Orr | |
| 5,910,026 | A * | 6/1999 | Geib | H01R 13/506 439/464 |
| 7,241,183 | B2 * | 7/2007 | Wasalaski | H01R 13/447 439/686 |
| 7,465,196 | B2 * | 12/2008 | Duarte | H01R 13/567 439/394 |
| 7,896,668 | B2 * | 3/2011 | Yash | H01R 13/506 439/153 |
| 8,197,270 | B2 | 6/2012 | Vasbinder | |

* cited by examiner

*Primary Examiner* — William H Mayo, III
*Assistant Examiner* — Hiram E Gonzales
(74) *Attorney, Agent, or Firm* — Kratz, Quintos & Hanson, LLP

(57) ABSTRACT

A multi-directional wiring routing device and method for operating thereof removably or permanently connects to a female housing of an electrical connector system. The multi-directional wiring routing device secures thereon and directs the wiring, at any desired routing direction, the wiring extending from the female housing. The wiring routing device includes an end portion having a substantially diamond-shape configuration portion, which is fitted into a corresponding substantially diamond-shape opening of the female housing of the electrical connector system. While maintaining the optimal performance of the electrical connector system, a bundle of wiring thereof can be neatly secured and efficiently routed towards any desired direction with the use of the multi-directional wiring routing device.

20 Claims, 10 Drawing Sheets

MULTI-DIRECTIONAL WIRING ROUTING DEVICE AND METHOD OF OPERATING THE SAME

BACKGROUND OF THE INVENTION

Field of the Invention

The present invention generally relates to a multi-directional wiring routing device and a method for operating thereof, the wiring routing device capable of being removably or permanently coupled to a female housing of an electrical connector system. More particularly, the multi-directional wiring routing device of this invention includes a first end portion, an intermediate portion, and a second end portion. The first end portion of the wiring routing device is removably or permanently coupled to the female housing, while the intermediate portion and second end portion of the wiring routing device accommodate thereon and direct the route towards any desired direction of a wiring bundle that extends from the female housing.

SUMMARY OF THE INVENTION

The multi-directional wiring routing device and method for operating thereof of this invention includes the first end portion, which removably or permanently connects to the female housing of the electrical connector system, and the intermediate portion and second end portion, which secure thereon and direct the wiring at any desired routing direction, the wiring extending from the female housing. While maintaining the optimal performance of the electrical connector system, a bundle of wiring thereof can be neatly secured by this invention, and efficiently routed towards any desired direction with the use of the intermediate portion and the second end portion of the wiring routing device of this invention.

The multi-directional wiring routing device and method for operating thereof of this invention include the first end portion thereof removably coupled or permanently coupled to the female housing of the electrical connector system. Alternatively, this invention may be removably coupled or permanently coupled to the connector position assurance (CPA) device or the TPA device of the electrical connector system.

DETAILED DESCRIPTION OF THE PREFERRED EMBODIMENTS

Figure 1:
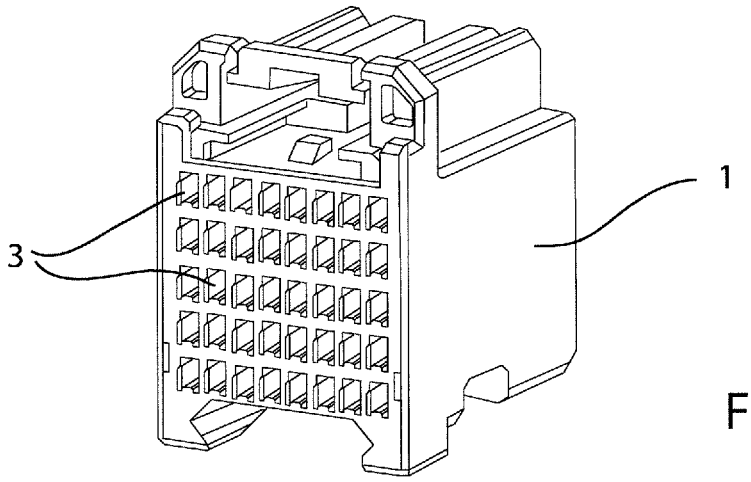
FIG. 1 is a perspective view of the female housing of the electrical connector system, which is connectable to the multi-directional wiring routing device of the present invention.
Figure 2:
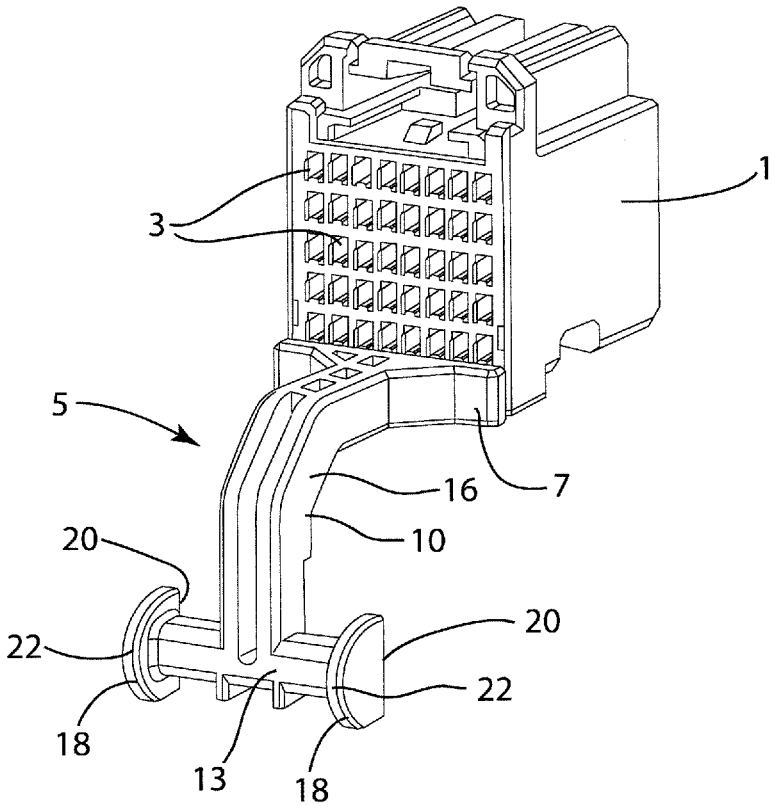
FIG. 2 is a perspective view of the multi-directional wiring routing device and the female housing being connected to each other.

FIG. 1 illustrates, in perspective view, a female housing 1 of an electrical connector system, while FIG. 2 illustrates a multi-directional wiring routing device (generally referred to by reference number 5) removably or permanently connected to the female housing 1. The female housing 1 includes wiring connecting holes 3, and has a substantially box-like configuration with a predetermined dimension.

As shown in FIG. 2, the multi-directional wiring routing device 5, generally includes a first end portion 7, an intermediate portion 10, and a second end portion 13. The intermediate portion 10 includes a bent portion 16. The second end portion 13 includes, on each side end thereof, a guard portion 18. The guard portion 18 has a substantially semi-circular shape with a substantially flat portion 20 and a substantially curved portion 22.

Figure 3:
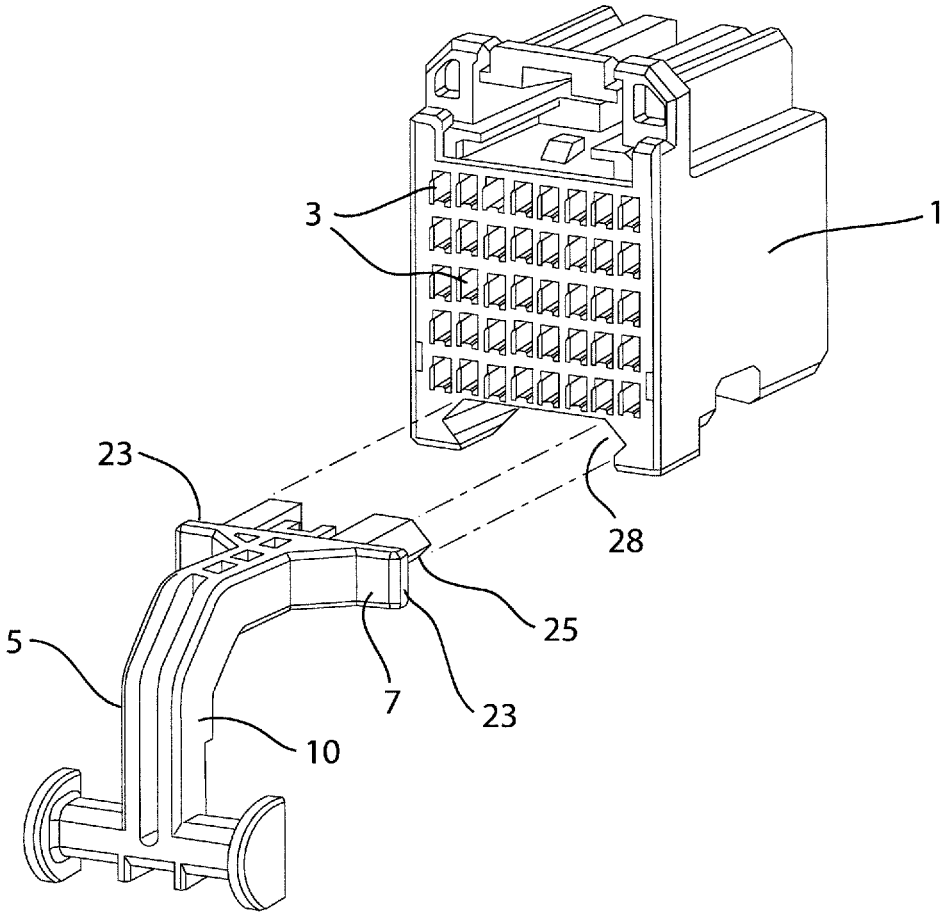
FIG. 3 is an exploded view of the multi-directional wiring routing device and the female housing showing a first end portion of the wiring routing device about to be joined to the female housing.
Figure 4:
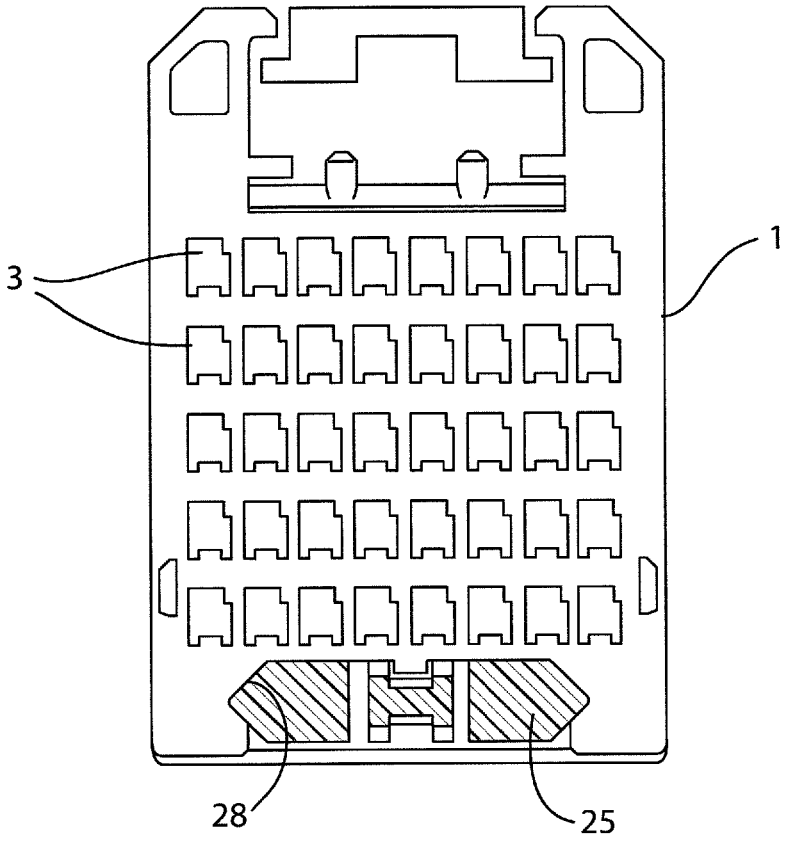
FIG. 4 is a back elevational view of the female housing showing the manner in which a substantially diamond-like shape member of the first end portion of the wiring routing device is accommodated and locked within the female housing.

Illustrated in FIG. 3 is the manner in which the first end portion 7 of the wiring routing device 5 connects with the female housing 1. Here, the first end portion 7 includes a substantially diamond-shaped member 25 to be inserted and accommodated within a substantially diamond-shaped opening 28 passing through a lower portion of the female housing 1. An elevational view showing the substantially diamond-shaped member 25 of the wiring routing device 5 is shown in FIG. 4. The substantially diamond-shaped member 25 is provided on each side of the first end portion 7, as shown in FIGS. 3 and 4. The substantially diamond-shaped members 25 respectively extend from substantially flat portions 23 of the first end portion 7 that faces the female housing 1.

The substantially diamond-shaped members 25 of the wiring routing device 5 to be fitted into the substantially diamond-shaped opening 28 of the female housing 1 are shaped as such so as to be symmetrical so that when the wiring routing device 5 is turned 180°, the substantially diamond-shaped members 25 will still fit and become accommodated within the substantially-shaped opening 28 of the female housing 1.

Figure 5:
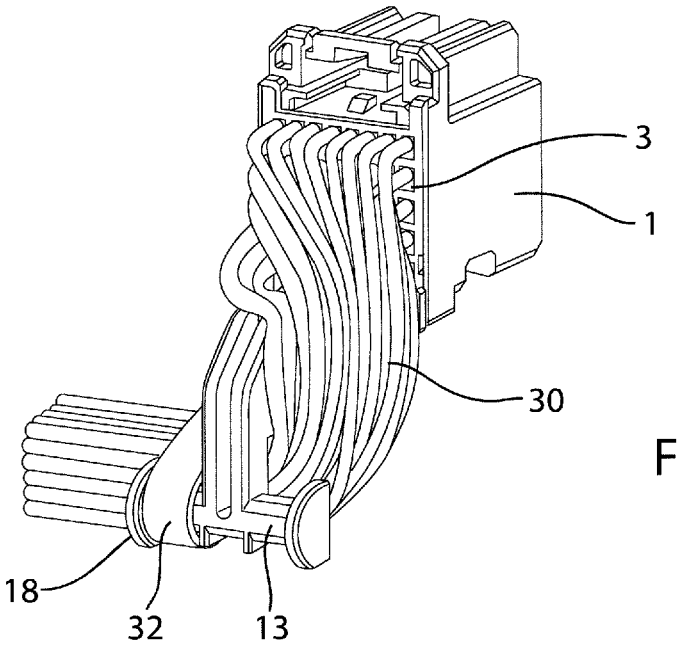
FIG. 5 is a perspective view of a wiring bundle extending from the female housing and being routed towards a leftward direction by the multi-directional wiring routing device.

When a wiring bundle 30 extends from the wiring connecting holes 3 of the female housing 1, while the wiring routing device 5 is connected to the female housing 1, the wiring bundle 30 is extended or routed, in its entirety, towards the leftward direction by having the wiring bundle 30 mount over the intermediate portion 10 of the wiring routing device 5 and turned towards the left, as shown in FIG. 5, and guided by the second end portion 13. As further illustrated in FIG. 5, while the wire bundle 30 is directed towards the left, a clamp 32 secures the wiring bundle 30, the clamp 32 surrounding the wire bundle 30 and the second end portion 13 of the wiring routing device 5. One of the guard portions 18 of the second end portion 13 prevents the clamp 32 from being dislodged or removed from the second end portion 13 of the wiring routing device 5.

Figure 6:
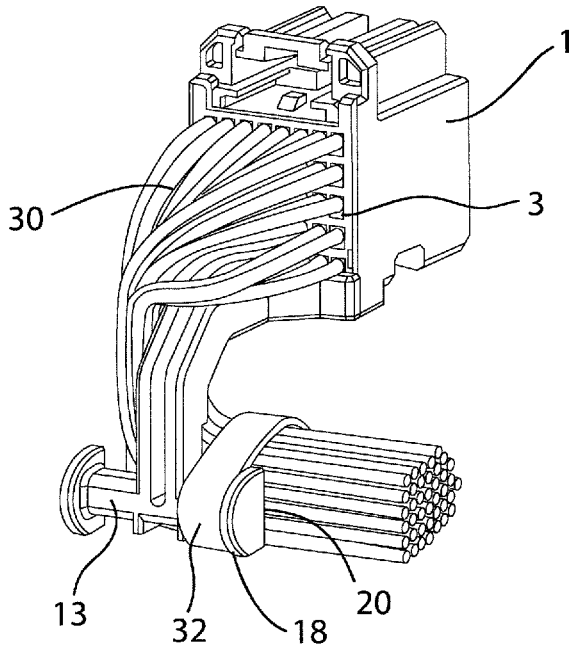
FIG. 6 is a perspective view of the wiring bundle extending from the female housing and being routed towards a rightward direction by the multi-directional wiring routing device.

As illustrated in FIG. 6, when the wiring bundle 30 extends from the wiring connecting holes 3 of the female housing 1, while the wiring routing device 5 is connected to the female housing 1, the wiring bundle 30 is extended or routed, in its entirety, towards the rightward direction by having the wiring bundle 30 mount over the intermediate portion 10 of the wiring routing device 5 and turned towards the right, as shown in FIG. 6, and guided by the second end portion 13. As further illustrated in FIG. 6, while the wiring bundle 30 is directed towards the right, a clamp 32 secures the wiring bundle 30, the clamp 32 surrounding the wiring bundle 30 and the second end portion 13 of the wiring routing device 5. One of the guard portions 18 of the second end portion 13 prevents the clamp 32 from being dislodged or removed from the second end portion 13 of the wiring routing device 5.

As shown in both FIGS. 5 and 6, while the clamp 32 surrounds and supports the wiring bundle 30, the wiring bundle 30 directly abuts against the substantially flat portion 20 of the guard portion 18 on the left-hand side of the second end portion 13 (FIG. 5) or the right-hand side of the second end portion 13 (FIG. 6) of the wiring routing device 5 when the wiring bundle 30 is directed or routed towards the left (FIG. 5) or towards the right (FIG. 6).

Figure 7:
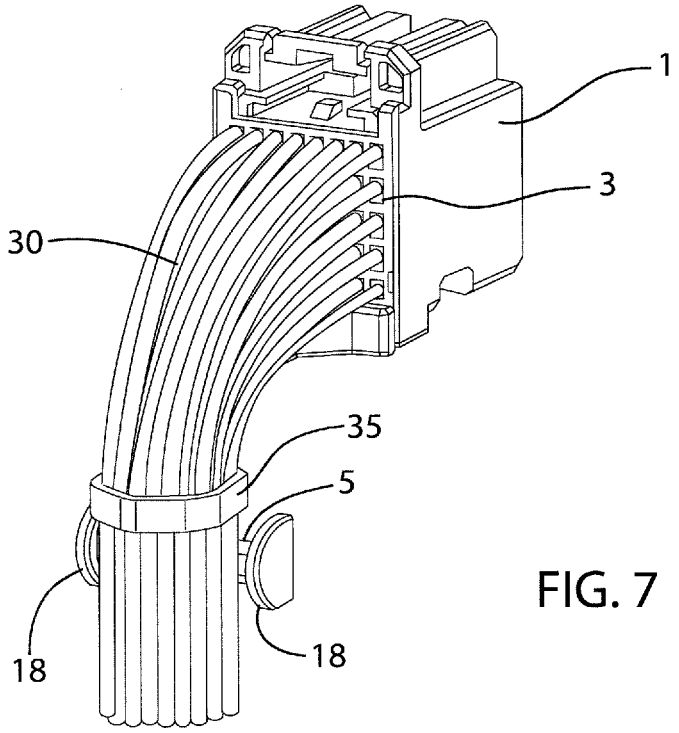
FIG. 7 is a perspective view of the wiring bundle extending from the female housing and being routed towards a downward direction by the multi-directional wiring routing device.

In FIG. 7, the wiring bundle 30 extending from the wiring connecting holes 3 of the female housing 1 mounts over the bent portion 16 of the intermediate portion 10 and extends over the second end portion 13 of the wiring routing device 5, the wiring bundle 30 being directed in the downward direction. A clamp 35 surrounds the wiring bundle 30 and the wiring routing device 5 to secure the wiring bundle 30 onto the wiring routing device 5.

Figure 8:
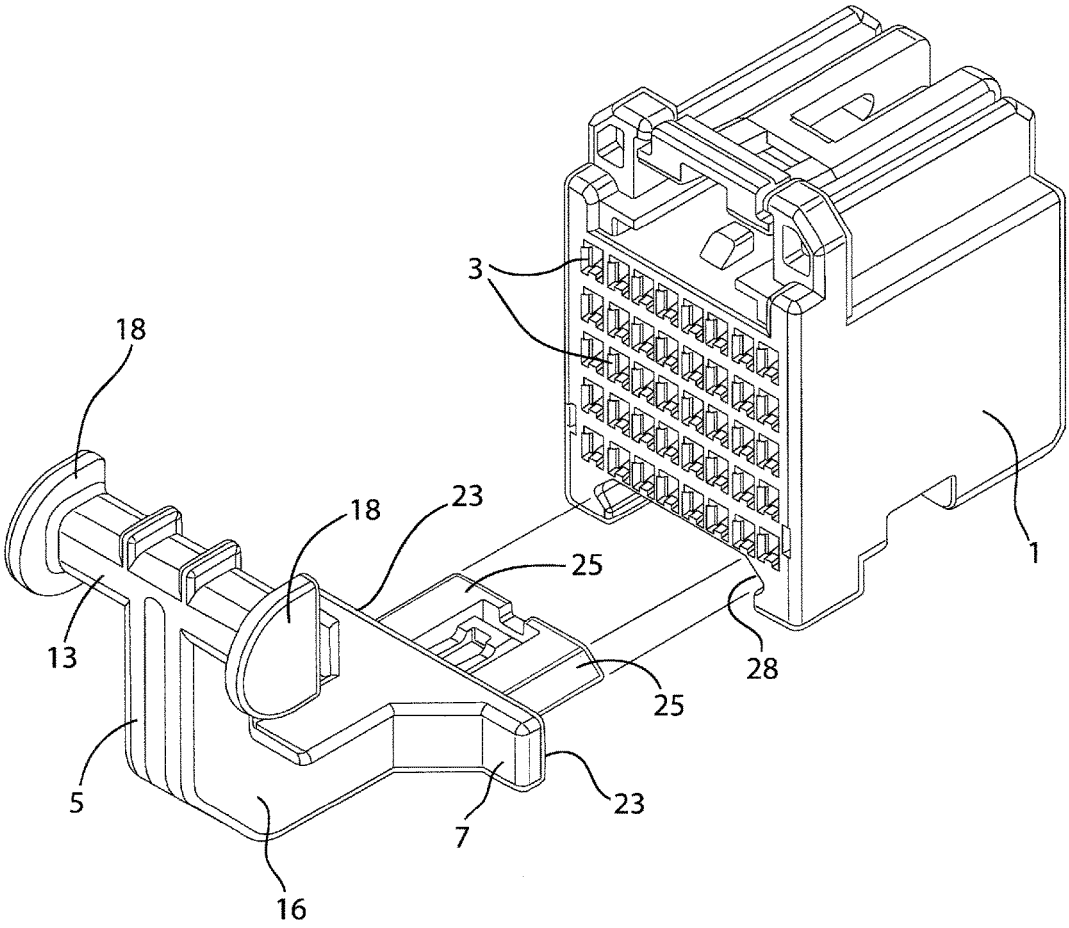
FIG. 8 is an exploded view of the multi-directional wiring routing device, similar to that shown in FIG. 3 except for it being turned or rotated by 180°, showing the first end portion of the wiring routing device about to be connected to the female housing.

FIG. 8 is an exploded view of the multiple-directional wiring routing device 5, similar to that shown in FIG. 3 except for it being turned by 180°, showing the first end portion 7 of the wiring routing device 5 about to be connected to the female housing 1. As shown in FIG. 8, the first end portion 7 includes the substantially diamond-shaped member 25 to be inserted and accommodated within the substantially diamond-shaped opening 28 passing through the lower portion of the female housing 1. The substantially diamond-shaped member 25 is provided on each side of the first end portion 7. As discussed above with respect to FIG. 3, the substantially diamond-shaped member 25 is provided on each side of the first end portion 7; and the substantially diamond-shaped members 25 respectively extend from the substantially flat portions 23 of the first end portion 7 that faces the female housing 1. When the wiring routing device 5 is joined to the female housing 1, the substantially diamond-shaped members 25 are fitted into and accommodated within the substantially diamond-shaped opening 28.

Figure 9:
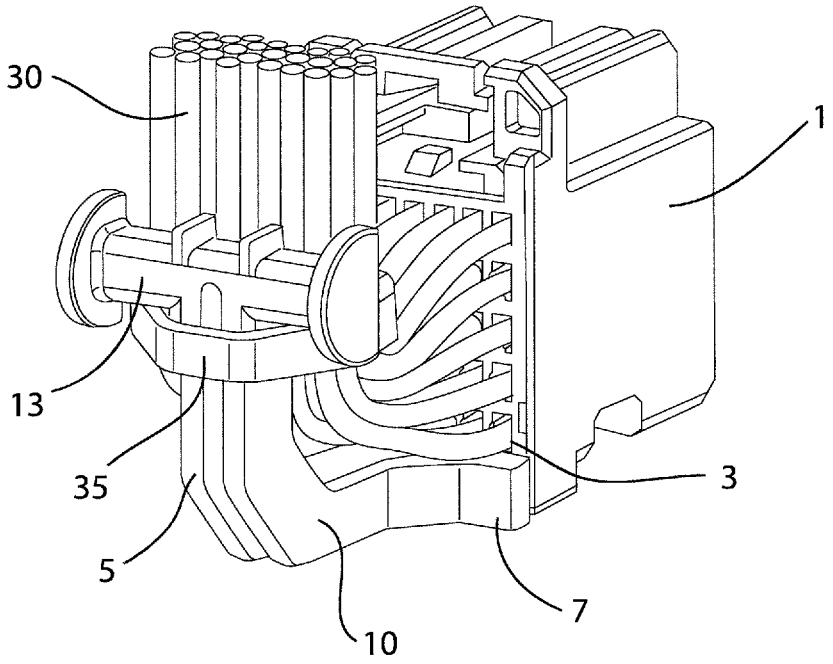
FIG. 9 is a perspective view of the wiring bundle extending from the female housing and being routed towards an upward direction by the multi-directional wiring routing device.

The wiring routing device 5 in FIG. 8 is shown in operation in FIG. 9, whereby the wiring bundle 30 extending from the wiring connecting holes 3 of the female housing 1 further extend along the first end portion 7, the intermediate portion 10, and the second end portion 13 in the upward direction. The wiring bundle 30 is secured onto the second end portion 13 by a clamp 35 surrounding the intermediate portion 10 of the wiring routing device 5 and the wiring bundle 30, as shown in FIG. 9.

Figure 10:
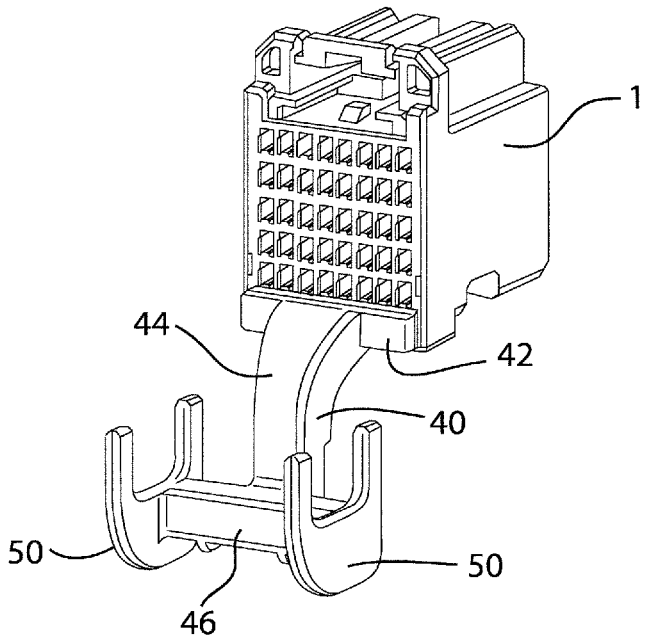
FIGS. 10 and 11 illustrate a perspective view of a second embodiment of the multi-directional wiring routing device connected to the female housing (FIG. 10) and in operation (FIG. 11).
Figure 11:
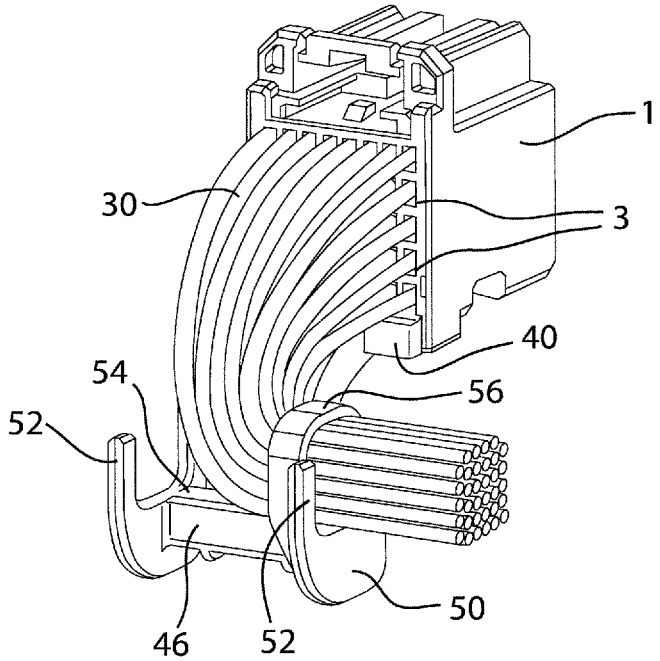

FIGS. 10 and 11 illustrate a second embodiment of the multi-directional wiring routing device 40, as connected to the female housing 1 (FIG. 10) and in operation (FIG. 11). The wiring routing device 40 also includes a first end portion 42, an intermediate portion 44, and a second end portion 46. The intermediate portion 44 is similarly bent, as in the first embodiment. The second end portion 46 includes at each end thereof a guard portion 50, each guard portion 50 having a substantially U-shaped configuration.

The first end portion 42 similarly includes substantially diamond-shaped portions (not shown), as in the first embodiment, extending from a substantially flat portion of the first end portion 42 that faces the female housing 1. The substantially diamond-shaped portions of the first end portion 42 of the wiring routing device 40 of the second embodiment are fitted into and accommodated within the substantially diamond-shaped opening 28 of the female housing 1.

As shown in FIG. 11, in the second embodiment of the wiring routing device 40, the wiring bundle 30 extending from the wiring connecting holes 3 of the female housing 1 further extend above and supported on the intermediate portion 44 and further extend towards the rightward direction and further supported by a ledge portion 54 of the second end portion 46 and the legs 52 of the substantially U-shaped guard portion 50. Because of the symmetrical configuration of the second end portion 46, which includes two opposing substantially U-shaped guard portions 52, the wiring bundle 30 can be similarly directed to the leftward direction and supported by the ledge portion 54 and the other one of the substantially U-shaped guard portions 50. As further shown in FIG. 11, a clamp 56, which surrounds the second end portion 46 and the wiring bundle 30, secures the wiring bundle 30 onto the ledge portion 54 and the substantially U-shaped guard portion 50. The wiring bundle 30 can also be directed towards the downward direction The substantially diamond-shaped members 25 of the wiring routing device 40 to be fitted into the substantially diamond-shaped opening 28 of the female housing 1 are shaped as such so as to be symmetrical so that when the wiring routing device 40 is turned 180°, the substantially diamond-shaped members 25 will still fit and become accommodated within the substantially-shaped opening 28 of the female housing 1. In such a structural arrangement, the wiring bundle 30 can be routed by the wiring routing device 40 of the second embodiment from the wiring holes 3 towards an upward direction.

Figure 12:
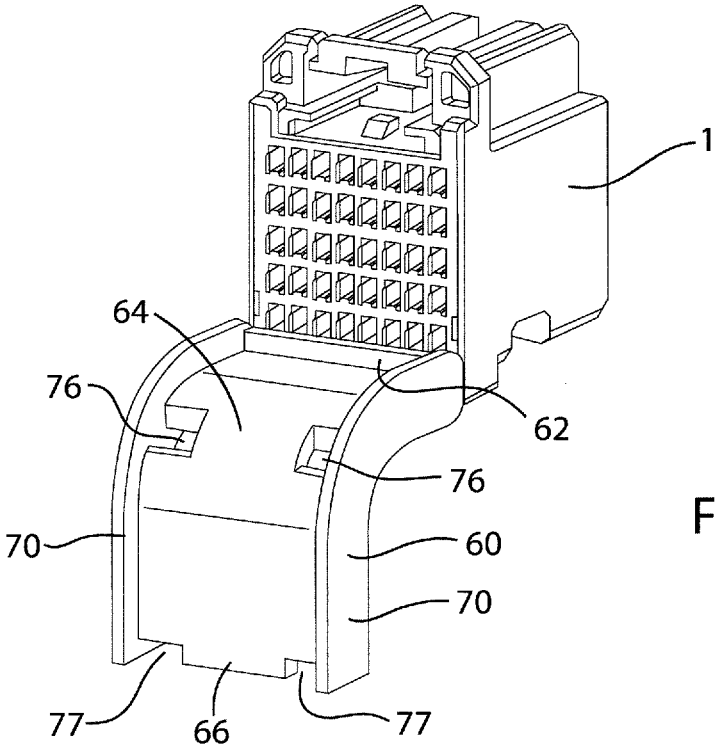
FIGS. 12 and 13 illustrate a perspective view of a third embodiment of the multi-directional wiring routing device connected to the female housing (FIG. 12) and in operation (FIG. 13).
Figure 13:
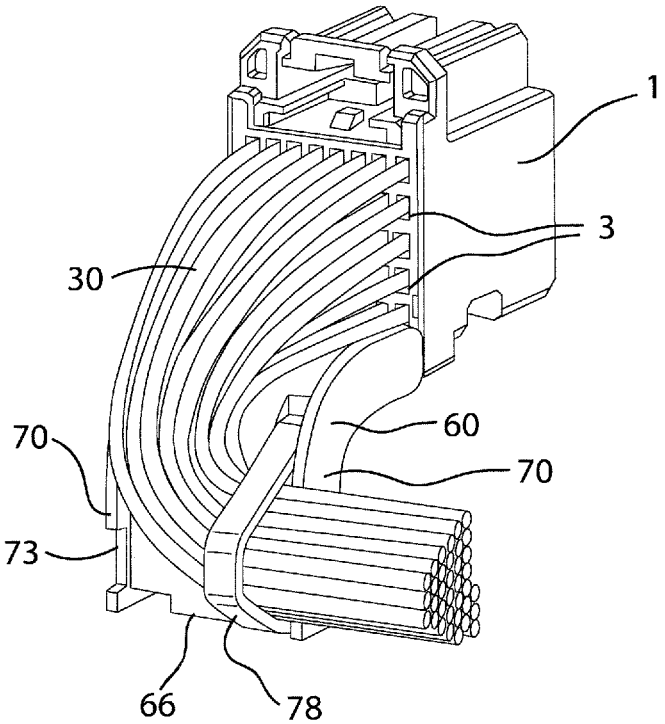

FIGS. 12 and 13 illustrate a third embodiment of the multi-directional wiring routing device 60, as connected to the female housing 1 (FIG. 12) and in operation (FIG. 13). The wiring routing device 60 also includes a first end portion 62, an intermediate portion 64, and a second end portion 66. The intermediate portion 64 is similarly bent, as in the first and second embodiments. At each of the side edges of the first end portion 62, the intermediate portion 64, and the second end portion 66 is an upstanding guard rail 70 extending along thereon.

The first end portion 62 similarly includes substantially diamond-shaped portions (not shown), as in the first and second embodiments, extending from a substantially flat portion of the first end portion 62 that faces the female housing 1. The substantially diamond-shaped portions of the first end portion 62 of the wiring routing device 60 of the third embodiment are fitted into and accommodated within the substantially diamond-shaped opening 28 of the female housing 1.

As shown in FIG. 13, in the third embodiment of the wiring routing device 60, the wiring bundle 30 extending from the wiring connecting holes 3 of the female housing 1 further extend above and supported on the intermediate portion 64 and further extend towards a rightward direction and may be further supported by at least an upstanding guard rail 70 along the first and intermediate portions 62, 64. Because of the symmetrical configuration of the wiring routing device 60, the wiring bundle 30 can be similarly directed to the leftward direction and supported by at least an upstanding guard rail 70 when routed towards the leftward direction or the downward direction. Each of the upstanding guard rails 70 near the second end portion 66 may include a notch 73, which may be used to further accommodate and support therein a portion of the wiring bundle 30.

In the third embodiment, the intermediate portion 64 includes a pair of apertures 76 and a pair of bottom notches 77 passing therethrough, as shown in FIG. 12. As shown in FIG. 13, a clamp 78 surrounds the wiring bundle 30 and the wiring routing device 60, while the clamp 78 passes through one of the apertures 76 and one of the bottom notches 77, so as to secure and support the wiring bundle 30.

The substantially diamond-shaped members 25 of the wiring routing device 60 to be fitted into the substantially diamond-shaped opening 28 of the female housing 1 are shaped as such so as to be symmetrical so that when the wiring routing device 60 is turned 180°, the substantially diamond-shaped members 25 will still fit and become accommodated within the substantially-shaped opening 28 of the female housing 1. In such a structural arrangement, the wiring bundle 30 extend from the wiring holes 3 along the wiring routing device 60 towards an upward direction.

Figure 14:
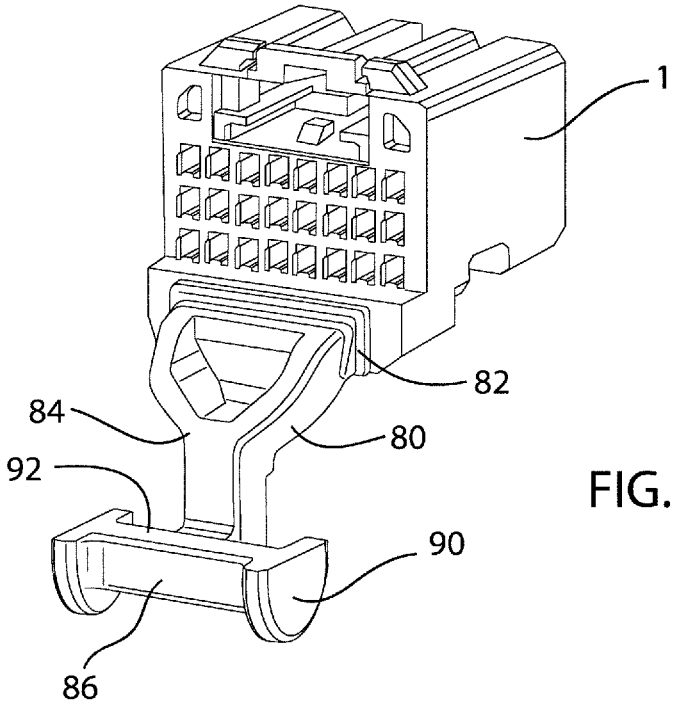
FIGS. 14 and 15 illustrate a perspective view of a fourth embodiment of the multi-directional wiring routing device connected to the female housing (FIG. 14) and in operation (FIG. 15).
Figure 15:
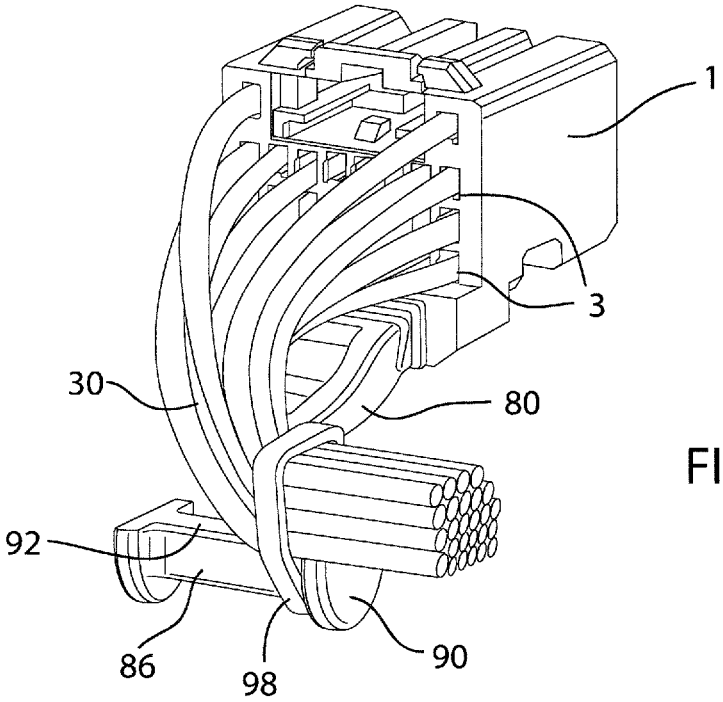

FIGS. 14 and 15 illustrate a fourth embodiment of the multi-directional wiring routing device 80, as connected to the female housing 1 (FIG. 14) and in operation (FIG. 15). The wiring routing device 80 also includes a first end portion 82, an intermediate portion 84, and a second end portion 86. The intermediate portion 84 is similarly bent, as in the first, second, and third embodiments. The second end portion 86 includes at each end thereof a guard portion 90, each guard portion 90 having a substantially U-shaped configuration, each of the flat portions of the guard portions 90 extend along the entire second end portion 86 to define a ledge 92.

The first end portion 82 similarly includes substantially diamond-shaped portions (not shown), as in the first, second, and third embodiments, extending from a substantially flat portion of the first end portion 82 that faces the female housing 1. The substantially diamond-shaped portions of the first end portion 82 of the wiring routing device 80 of the fourth embodiment are fitted into and accommodated within the substantially diamond-shaped opening 28 of the female housing 1.

As shown in FIG. 15, in the fourth embodiment of the wiring routing device 80, the wiring bundle 30 extending from the wiring connecting holes 3 of the female housing 1 further extend above and supported on the intermediate portion 84 and further extend towards the rightward direction and further supported by the ledge portion 92 of the second end portion 86. Because of the symmetrical configuration of the second end portion 86, the wiring bundle 30 can be similarly directed to the leftward direction and supported by the ledge 92. As further shown in FIG. 15, a clamp 98 surrounds the wiring bundle 30 and the second end portion 86 to secure the wiring bundle 30 onto the ledge 92. Although not shown, the wiring bundle 30 can also be directed towards the downward direction abutting the second end portion 86 between the guard portions 90 with the clamp 98 surrounding the wiring bundle 30 and the intermediate portion 84 to secure the wiring bundle 30.

The substantially diamond-shaped members 25 of the wiring routing device 80 to be fitted into the substantially diamond-shaped opening 28 of the female housing 1 are shaped as such so as to be symmetrical so that when the wiring routing device 80 is turned 180°, the substantially diamond-shaped members 25 will still fit and become accommodated within the substantially-shaped opening 28 of the female housing 1. In such a structural arrangement, the wiring bundle 30 extend from the wiring holes 3 along the wiring routing device 80 towards an upward direction.

In all of the embodiments of the wiring routing device, in order to minimize the space needed for the implementation or use of this invention, it is preferable that the sizes of the first end portion, the intermediate portion, and the second end portion be at most the width of the female housing, the connector position assurance (CPA) device or the TPA of the electrical connector system to which the multi-directional wiring routing device of this invention connects.

The present invention is not limited to the above-described embodiments; and various modifications in design, structural arrangement or the like may be used without departing from the scope or equivalents of the present invention.

We claim:

1. A multi-directional wiring routing device of an electrical connector system, comprising:

a first end portion connected to the electrical connector system;

an intermediate portion, the intermediate portion being substantially bar-shaped and bent; and a second end portion, wherein the first end portion, the intermediate portion, and the second end portion receive thereon a wiring bundle extending from a member of the electrical connector system, and wherein the second end portion directs or routes the wiring bundle to any desired direction, and wherein the second end portion includes multiple members for directing or routing the wiring bundle, each member of the multiple members directing or routing the wiring bundle to a corresponding direction.

2. The multi-directional wiring routing device as in claim 1, wherein the second end portion directs or routes the wiring bundle towards one of a rightward direction, a leftward direction, a downward direction, and an upward direction.

3. The multi-directional wiring routing device as in claim 2, wherein the second end portion includes a guard portion at each end thereof.

4. The multi-directional wiring routing device as in claim 3, wherein the guard portion includes a ledge portion onto which the wiring bundle abuts.

5. The multi-directional wiring routing device as in claim 3, wherein the guard portion includes a substantially U-shaped portion for accommodating therein the wiring bundle directed thereinto.

6. The multi-directional wiring routing device as in claim 1, wherein the first end portion includes a substantially symmetrically-shaped extending member for fitting and being accommodated into a similarly substantially symmetrically-shaped opening passing through the member of the electrical connector system, the first end portion being connected to the member of the electrical connector system from which the wiring bundle extends.

7. The multi-directional wiring routing device as in claim 6, wherein the guard portion is substantially semi-circular configuration having a flat portion, wherein the wiring bundle being routed abuts against the flat portion of the guard portion.

8. The multi-directional wiring routing device as in claim 6, wherein the first end portion is connected to the member of the electrical connector system with the multi-directional wiring routing device being oriented at a first orientation.

9. The multi-directional wiring routing device as in claim 8, wherein the first end portion is connected to the member of the electrical connector system with the multi-directional wiring routing device being oriented at a second orientation, the first and second orientations differing by a 180° rotation.

10. The multi-directional wiring routing device as in claim 6, wherein the member of the electrical connector system from which the wiring bundle extends is at least one of a female housing, a connector position assurance (CPA) device, and a terminal position assurance (TPA) device.

11. The multi-directional wiring routing device as in claim 6, wherein the size of the first, intermediate, and second portions are at most the width of the member of the electrical connector system from which the wiring bundle extends and to which the first end portion connects.

12. The multi-directional wiring routing device as in claim 1, further including a clamp for securing the wiring bundle onto at least one of the first end portion, the intermediate portion, and the second end portion.

13. The multi-directional wiring routing device as claim 1, wherein the member of the electrical connector system from which the wiring bundle extends is permanently connected to the first end portion.

14. The multi-directional wiring routing device as claim 1, wherein the member of the electrical connector system from which the wiring bundle extends is temporarily connected to the first end portion.

15. A method for routing a wiring bundle that extends from a member of an electrical connector system, comprising the steps of:

receiving the wiring bundle with a multi-directional wiring routing device, the multi-directional wiring routing device having a first end portion being connected to the member of the electrical connector system; and directing the wiring bundle with the multi-directional wiring routing device towards a desired direction, wherein the multi-directional wiring routing device includes a second end portion having multiple members for directing or routing the wiring bundle, each member of the multiple members directing or routing the wiring bundle to a corresponding direction, and wherein the multi-directional wiring routing device further includes a substantially bar-shaped intermediate portion between the first end portion and the second end portion.

16. The method for routing the wiring bundle as in claim 15, wherein the multi-directional wiring routing device is permanently connected to the member of the electrical connector, the member of the electrical connector being at least one of a female housing, a connector position assurance (CPA) device and a terminal position assurance (TPA) device.

17. The method for routing the wiring bundle as in claim 15, wherein the multi-directional wiring routing device is temporarily connected to the member of the electrical connector, the member of the electrical connector being at least one of a female housing, a connector position assurance (CPA) device and a terminal position assurance (TPA) device.

18. The method for routing the wiring bundle as in claim 15, wherein the first end portion is connected to the member of the electrical connector system with the multi-directional wiring routing device being oriented at one of a first orientation and a second orientation, the first and second orientations differing by a 180° rotation.

19. The method for routing the wiring bundle as in claim 15, wherein the multi-directional wiring routing device being connected to the member of the electrical connector system with a substantially symmetrically-shaped extending member of the first end portion fitting and being accommodated into a similarly substantially symmetrically-shaped opening passing through the member of the electrical connector system.

20. The method for routing the wiring bundle as in claim 15, further comprising the step of clamping the wiring bundle onto the multi-directional wiring routing device.

* * * * *